US012637257B2

(12) United States Patent
Xu

(10) Patent No.: US 12,637,257 B2
(45) Date of Patent: May 26, 2026

(54) QUICK OPENING AND CLOSING CONTAINER STOPPER

(71) Applicant: Dongfeng Xu, Quzhou (CN)

(72) Inventor: Dongfeng Xu, Quzhou (CN)

( * ) Notice: Subject to any disclaimer, the term of this patent is extended or adjusted under 35 U.S.C. 154(b) by 1 day.

(21) Appl. No.: 18/918,812

(22) Filed: Oct. 17, 2024

(65) Prior Publication Data

US 2025/0145338 A1 May 8, 2025

(30) Foreign Application Priority Data

Nov. 3, 2023 (CN) ..... 202322988533.2

(51) Int. Cl.

| | |
|---|---|
| ***B65D 39/12*** | (2006.01) |
| ***B65D 39/00*** | (2006.01) |
| ***B65D 39/16*** | (2006.01) |
| ***B65D 45/32*** | (2006.01) |

(52) U.S. Cl.

CPC ..... *B65D 39/12* (2013.01); *B65D 39/0052* (2013.01); *B65D 39/16* (2013.01); *B65D 45/32* (2013.01); *B65D 2539/003* (2013.01)

(58) Field of Classification Search

CPC .... B65D 39/12; B65D 39/0052; B65D 39/16; B65D 45/32; B65D 2539/003

USPC ..... 220/234, 235, 236, 237, 238; 215/358, 215/359, 360, 361; 138/89, 90

See application file for complete search history.

(56) References Cited

U.S. PATENT DOCUMENTS

| | | | | |
|---|---|---|---|---|
| 932,948 | A * | 8/1909 | Baxter | B65D 39/12 215/359 |
| 7,731,043 | B2 * | 6/2010 | Wang Wu | B65D 39/14 215/361 |
| 9,340,329 | B2 * | 5/2016 | Melinger | B65D 39/12 |
| 2016/0280427 | A1 * | 9/2016 | Wu | B65D 41/0485 |

* cited by examiner

*Primary Examiner* — James N Smalley
(74) *Attorney, Agent, or Firm* — JEEN IP LAW, LLC

(57) ABSTRACT

The present disclosure relates to the field of bottle stopper devices, and in particular, to a quick opening and closing container stopper, which includes a fixed shell and a movable stopper body. The fixed shell is provided with a dodging opening. The movable stopper body is provided with a limiting plate. An elastic sealing sleeve abuts against and between the limiting plate and the fixed shell. A knob is rotatably connected to the movable stopper body. The knob includes a side lug. When the container stopper is in a locked state, the side lug extends beyond a contour range of the dodging opening, and the fixed shell and the limiting plate are close to each other and drive the elastic sealing sleeve to bulge outward. When the container stopper is in an unlocked state, the side lug is accommodated in the dodging opening.

11 Claims, 10 Drawing Sheets

QUICK OPENING AND CLOSING CONTAINER STOPPER

CROSS-REFERENCE TO RELATED APPLICATIONS

This application claims priority to Chinese Patent Application No. 202322988533.2, filed on Nov. 3, 2023, which is hereby incorporated by reference in its entirety.

TECHNICAL FIELD

The present disclosure relates to the field of bottle stopper devices, and in particular, to a quick opening and closing container stopper.

BACKGROUND

It is well known that the existing cup or bottle is typically sealed with a threaded bottle stopper or a solid rubber stopper, which is inconvenient in daily use. For example, the threaded bottle stopper needs to be opened and closed by complicated rotation during use. Especially when the temperature is low and the pressure in the bottle becomes smaller, it will take more time and more effort to rotate the bottle stopper to open it. For another example, the solid rubber stopper often needs other auxiliary tools to open it, and it takes a lot of time. A rubber stopper that is easy to open often has poor sealing performance and a short service life, and is prone to falling directly into the container after long-term use.

SUMMARY

To solve the above problems, the present disclosure provides a container stopper which is convenient to open and close quickly and has the advantages of long service life, good sealing performance and low cost.

The present disclosure adopts the following technical solutions: a quick opening and closing container stopper includes a fixed shell with a hollow inside. A movable stopper body is slidably connected in the fixed shell in a vertical direction, and the fixed shell is provided with a dodging opening. A bottom of the movable stopper body is provided with a limiting plate. An elastic sealing sleeve abuts against and between the limiting plate and the fixed shell. A knob is rotatably connected to the movable stopper body. The knob includes a side lug. The container stopper is switchable between a locked state and an unlocked state.

In the locked state, the side lug extends beyond a contour range of the dodging opening, and the fixed shell and the limiting plate are close to each other and drive the elastic sealing sleeve to bulge outward.

In the unlocked state, the side lug is accommodated in the dodging opening, and the elastic sealing sleeve stretches while the fixed shell and the limiting plate are away from each other.

Through the above technical solution, in the process of driving the movable stopper body to slide upward, the whole elastic sealing sleeve is squeezed by the limiting plate and the fixed shell, so that the elastic sealing sleeve bulges outward to seal the container. After the movable stopper body is driven to slide upward, the knob is rotated until the side lug extends beyond the contour range of the dodging opening and abuts against the fixed shell, so that the elastic sealing sleeve keeps bulging outward and sealing the container. When the knob is rotated such that the whole knob is within the contour range of the dodging opening, the knob and the movable stopper body are moved downward relatively under the elastic force of the elastic sealing sleeve, and the elastic sealing sleeve stretches and returns to its original shape to unlock the container opening. Thus, a user can open and close the container stopper simply by operating the movable stopper body and the knob, which makes the container stopper very convenient to use. The container stopper can be used repeatedly, and thus has a longer service life. Moreover, the present disclosure is simple in structure and lower in production costs.

Further, the knob includes a central post. A side surface of the central post is provided with a first connector. The movable stopper body is provided with a second connector. A first elastic member is connected between the first connector and the second connector. While the knob switches from the locked state to the unlocked state, the first elastic member is extended and tightened.

Through the above technical solution, after the movable stopper body is driven to move upward until the side lug leaves the dodging opening, the knob is rotated under the pulling force of the first elastic member, so that the side lug automatically rotates to extend beyond the contour range of the dodging opening. Thus, the user can switch the container stopper to the locked state simply by driving the movable stopper body to move upward in a single operation, which makes the container stopper more convenient to use.

Further, the movable stopper body is provided with a limiting edge, and a side edge of the central post is provided with a limiting block. In the locked state, the limiting block abuts against the limiting edge.

Through the above technical solution, when the limiting block abuts against the limiting edge, the limiting block is subjected to the elastic force and the reverse thrust of the limiting edge, so that the knob in the locked state is more stable and the orientation of the side lug is more standardized.

Further, the movable stopper body includes an accommodating cavity and a mounting hole communicated with each other. The mounting hole is configured for the central post to pass through. The first connector and the first elastic member are both located in the accommodating cavity, and the second connector is arranged on an inner wall of the accommodating cavity.

Through the above technical solution, corrosion of water vapor on the first connector, the second connector and the first elastic member is avoided, so that the service life is prolonged. Moreover, breeding of bacteria is reduced, which makes the container stopper more sanitary to use.

Further, the movable stopper body includes a stopper body main body and a cover plate that are detachably connected, and the accommodating cavity and the mounting hole are both formed by splicing the stopper body main body and the cover plate.

Through the above technical solution, the movable stopper body is simple in structure, so that the movable stopper body is convenient to assemble.

Further, the stopper body main body and the cover plate are respectively provided with a convex portion and a concave portion, or the stopper body main body and the cover plate are respectively provided with the concave portion and the convex portion. The convex portion and the concave portion are matched with each other. The stopper body main body and the cover plate are respectively provided with a through hole and a hook, or the stopper body main body and the cover plate are respectively provided with the hook and the through hole. The through hole is arranged in a strip shape in the vertical direction, and the hook and the through hole are detachably connected.

Through the above technical solution, after the concave portion and the convex portion are butted with each other, the hook and the through hole can be clamped with each other so as to complete the connection and mounting of the stopper body main body and the cover plate, which makes the mounting very convenient.

Further, a bottom of the central post is provided with a positioning disk extending outward, an annular groove matched with the positioning disk is arranged inside the movable stopper body, and the positioning disk and the annular groove are rotatably connected.

Through the above technical solution, the axial position of the central post relative to the movable stopper body can be determined by positioning the positioning disk and the annular groove, which is simple in structure and convenient to mount.

Further, the quick opening and closing container stopper further includes a movable rod. A side edge of the movable rod is provided with a limiting disk. A bottom of the movable rod is provided with a sealing block. A movable cavity for accommodating the limiting disk is arranged in the movable stopper body. A second elastic member abuts against and between the limiting disk and a bottom of the movable cavity. A middle part of the limiting plate is provided with a venthole communicated with the movable cavity. An upper part of the movable rod runs through the knob.

Through the above technical solution, under normal conditions, when the second elastic member extends to its limit, the sealing block blocks the venthole to ensure the air tightness of the present disclosure. Thus, when opening the container stopper, the user may press an upper end of the movable rod to push the sealing block to move downward and open the venthole, so that an air pressure balance between the inside and the outside can be achieved, thereby preventing the air pressure from inhibiting the opening of the container stopper.

Further, the fixed shell includes a hollow grip, and the movable stopper body includes a handle. A sliding slot slidably connected with an edge of the movable stopper body is provided in the fixed shell. The hollow grip is provided with an arc groove for accommodating the handle. The sliding slot and the arc groove are communicated with each other.

Through the above technical solution, the user can drive the movable stopper body to move upward simply by pulling the handle, which makes the container stopper more convenient to use.

Further, an outer side of the side lug is provided with a squeezing protrusion, an inner side of the handle is provided with a squeezing surface for abutting against and locking the squeezing protrusion, and a side edge of the squeezing surface is provided with a stop block.

Through the above technical solution, when the knob is rotated until the squeezing protrusion abuts against the stop block, the squeezing protrusion abuts against and locks the squeezing surface, so that the movable stopper body together with the knob can smoothly pass through the dodging opening during the assembly process of the present disclosure, which makes the container stopper convenient to assemble.

Further, a side edge of the movable stopper body is provided with a limiting protrusion, and the inside of the fixed shell is provided with a strip-shaped limiting slot in the vertical direction. The limiting protrusion is slidably connected in the strip-shaped limiting slot. In the unlocked state, the limiting protrusion abuts against a bottom end of the strip-shaped limiting slot.

Through the above technical solution, the distance between the movable stopper body and the fixed shell can be effectively limited, which avoids useless work and improves use efficiency.

BRIEF DESCRIPTION OF DRAWINGS

To describe the technical solutions in the examples of the present disclosure or in existing technologies more clearly, the accompanying drawings required for describing the examples or existing technologies are briefly described below. Apparently, the accompanying drawings in the following description show some examples of the present disclosure, and a person of ordinary skill in the art may still derive other drawings from the structures shown by these accompanying drawings without creative efforts.

REFERENCE SIGNS

Figure 1:
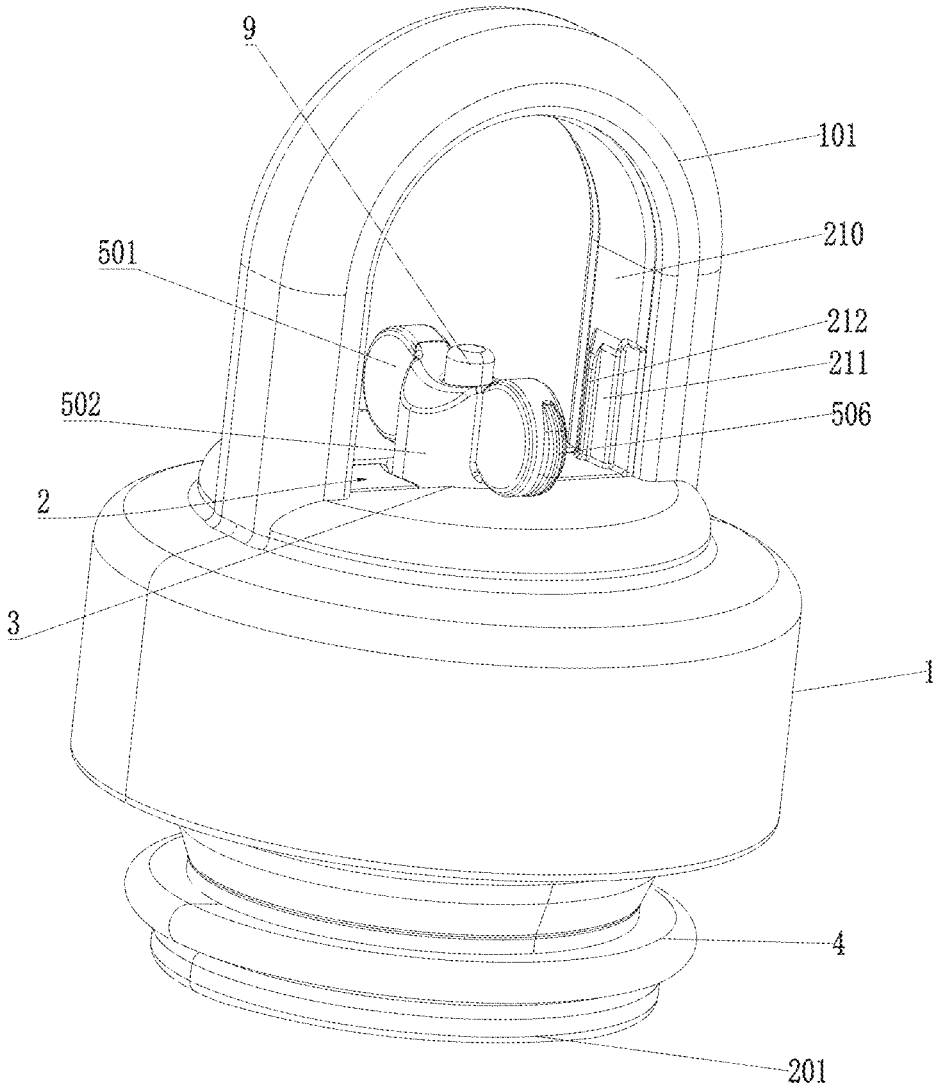
FIG. 1 is a schematic overall structural view of the present disclosure in a locked state.

1, fixed shell; 2, movable stopper body; 3, dodging opening; 4, elastic sealing sleeve; 5, knob; 6, second connector; 7, first elastic member; 8, limiting edge; 9, movable rod; 10, limiting disk; 11, sealing block; 12, second elastic member; 101, hollow grip; 102, sliding slot; 103, arc groove; 104, strip-shaped limiting slot; 21, stopper body main body; 22, cover plate; 201, limiting plate; 202, accommodating cavity; 203, mounting hole; 204, convex portion; 205, concave portion; 206, through hole; 207, hook; 208, annular groove; 209, venthole; 210, handle; 211, squeezing surface; 212, stop block; 213, movable cavity; 214, limiting protrusion; 501, side lug; 502, central post; 503, first connector; 504, limiting block; 505, positioning disk; and 506, squeezing protrusion.

The implementation, functional characteristics, and advantages of the present disclosure will be further described in conjunction with the examples, with reference to the accompanying drawings.

DESCRIPTION OF EMBODIMENTS

The following clearly and completely describes the technical solutions in the examples of the present disclosure with reference to the accompanying drawings in the examples of the present disclosure. Apparently, the described examples are merely some but not all of the examples of the present disclosure. All other examples obtained by a person of ordinary skill in the art based on the examples of the present disclosure without creative efforts shall fall within the protection scope of the present disclosure.

It should be noted that all directional indications (such as upper, lower, left, right, front, rear . . . ) in the examples of the present disclosure are only used for explaining a relative position relationship and a motion situation between components in a specific posture (as shown in the figure). If the specific posture changes, the directional indication also changes accordingly.

In addition, the terms "first" and "second" involved in the present disclosure are merely used for descriptive purposes, and cannot be understood as indicating or implying relative importance or implicitly indicating the number of technical features indicated. Thus, the features defined with "first" and "second" may explicitly or implicitly include at least one such feature. In addition, the technical solutions of the examples may be combined with each other, which must be based on the fact that those of ordinary skill in the art are able to realize it. When the combination of technical solutions is contradictory or impossible to realize, it should be considered that this combination of technical solutions does not exist and is not within the scope of protection of the present disclosure.

Referring to FIGS. 1, 2, 4, 5, 6, 7 and 10, a quick opening and closing container stopper includes a fixed shell 1 with a hollow inside. A movable stopper body 2 is slidably connected in the fixed shell 1 in a vertical direction, and the fixed shell 1 is provided with a dodging opening 3. A bottom of the movable stopper body 2 is provided with a limiting plate 201. An elastic sealing sleeve 4 abuts against and between the limiting plate 201 and the fixed shell 1. A knob 5 is rotatably connected to the movable stopper body 2. The knob 5 includes a side lug 501. The container stopper is switchable between a locked state and an unlocked state.

In the locked state, the side lug 501 extends beyond a contour range of the dodging opening 3, and the fixed shell 1 and the limiting plate 201 are close to each other and drive the elastic sealing sleeve 4 to bulge outward.

In the unlocked state, the side lug 501 is accommodated in the dodging opening 3, and the elastic sealing sleeve 4 stretches while the fixed shell 1 and the limiting plate 201 are away from each other.

In the process of driving the movable stopper body 2 to slide upward, the whole elastic sealing sleeve 4 is squeezed by the limiting plate 201 and the fixed shell 1, so that the elastic sealing sleeve 4 bulges outward to seal the container. After the movable stopper body 2 is driven to slide upward, the knob 5 is rotated until the side lug 501 extends beyond the contour range of the dodging opening 3 and abuts against the fixed shell 1, so that the elastic sealing sleeve 4 keeps bulging outward and sealing the container. When the knob 5 is rotated such that the whole knob 5 is within the contour range of the dodging opening 3, the knob 5 and the movable stopper body 2 are moved downward relatively under the elastic force of the elastic sealing sleeve 4, and the elastic sealing sleeve 4 stretches and returns to its original shape to unlock the container opening. Thus, a user can open and close the container stopper simply by operating the movable stopper body 2 and the knob 5, which makes the container stopper very convenient to use. The container stopper can be used repeatedly, and thus has a longer service life. Moreover, the present disclosure is simple in structure and lower in production costs.

Preferably, two side lugs 501 are provided and arranged symmetrically, so that the knob 5 is more evenly stressed through the side lugs 501.

Preferably, the whole movable stopper body 2 is in the shape of a flat block, and the corresponding dodging opening 3 is rectangular.

Preferably, the elastic sealing sleeve 4 is made of rubber.

Referring to FIG. 1 to FIG. 7, the knob 5 includes a central post 502. A side surface of the central post 502 is provided with a first connector 503. The movable stopper body 2 is provided with a second connector 6. A first elastic member 7 is connected between the first connector 503 and the second connector 6. While the knob 5 switches from the locked state to the unlocked state, the first elastic member 7 is extended and tightened. After the movable stopper body 2 is driven to move upward until the side lug 501 leaves the dodging opening 3, the knob 5 is rotated under the pulling force of the first elastic member 7, so that the side lug 501 automatically rotates to extend beyond the contour range of the dodging opening 3. Thus, the user can switch the container stopper to the locked state simply by driving the movable stopper body 2 to move upward in a single operation, which makes the container stopper more convenient to use.

Preferably, the first elastic member 7 is a spring.

Referring to FIGS. 2, 3, 8 and 9, the movable stopper body 2 is provided with a limiting edge 8, and a side edge of the central post 502 is provided with a limiting block 504. In the locked state, the limiting block 504 abuts against the limiting edge 8. When the limiting block 504 abuts against the limiting edge 8, the limiting block 504 is subjected to the elastic force and the reverse thrust of the limiting edge 8, so that the knob 5 in the locked state is more stable and the orientation of the side lug 501 is more standardized.

It is preferred in the present disclosure that the limiting block 504 in the locked state can keep stable under the pulling force of the first elastic member 7 and the abutting force of the limiting edge 8, and the first elastic member 7 in the locked state returning to its natural extended state also does not deviate from the scope of protection of the present disclosure.

Figure 2:
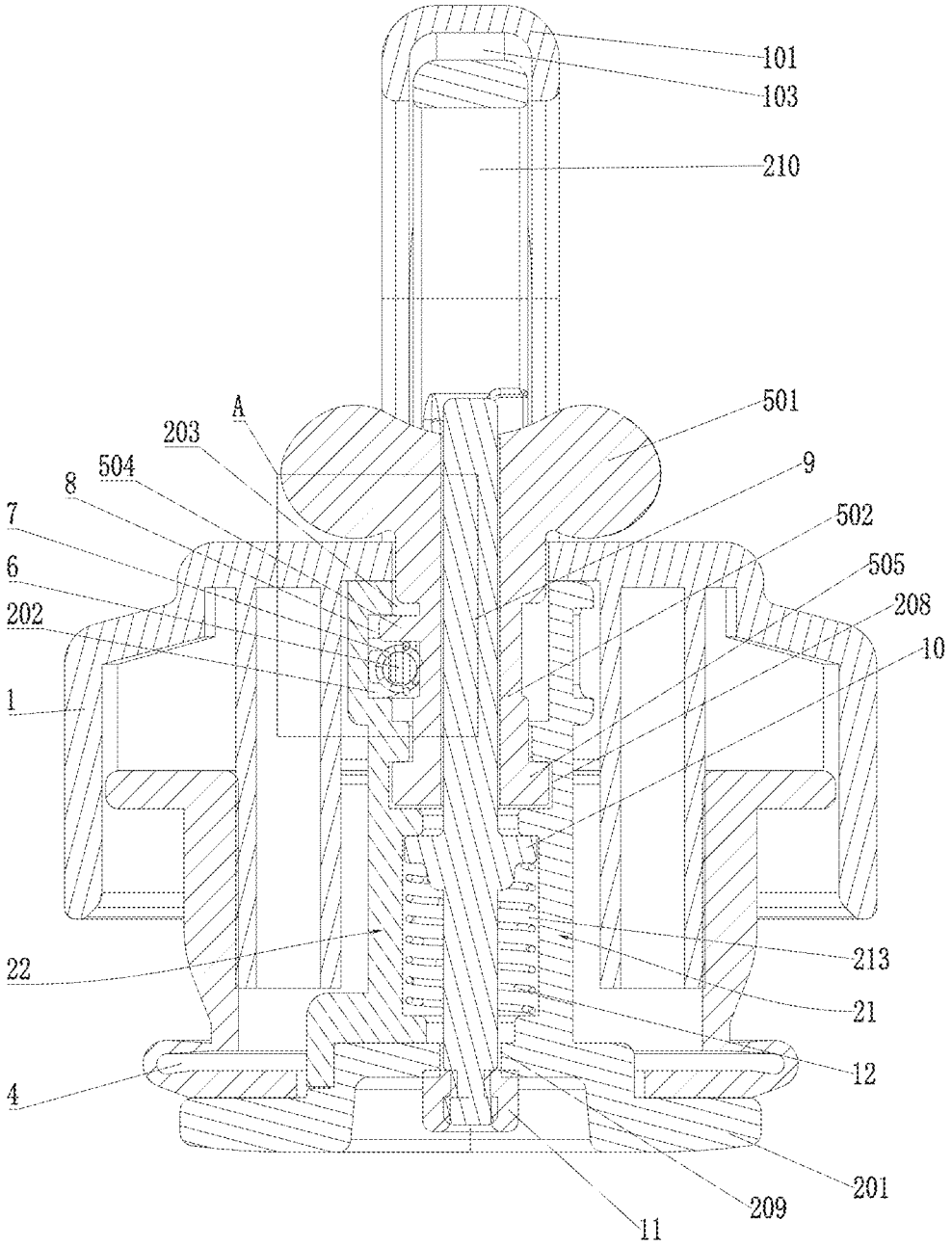
FIG. 2 is a schematic internal structural view of the present disclosure in a locked state.
Figure 3:
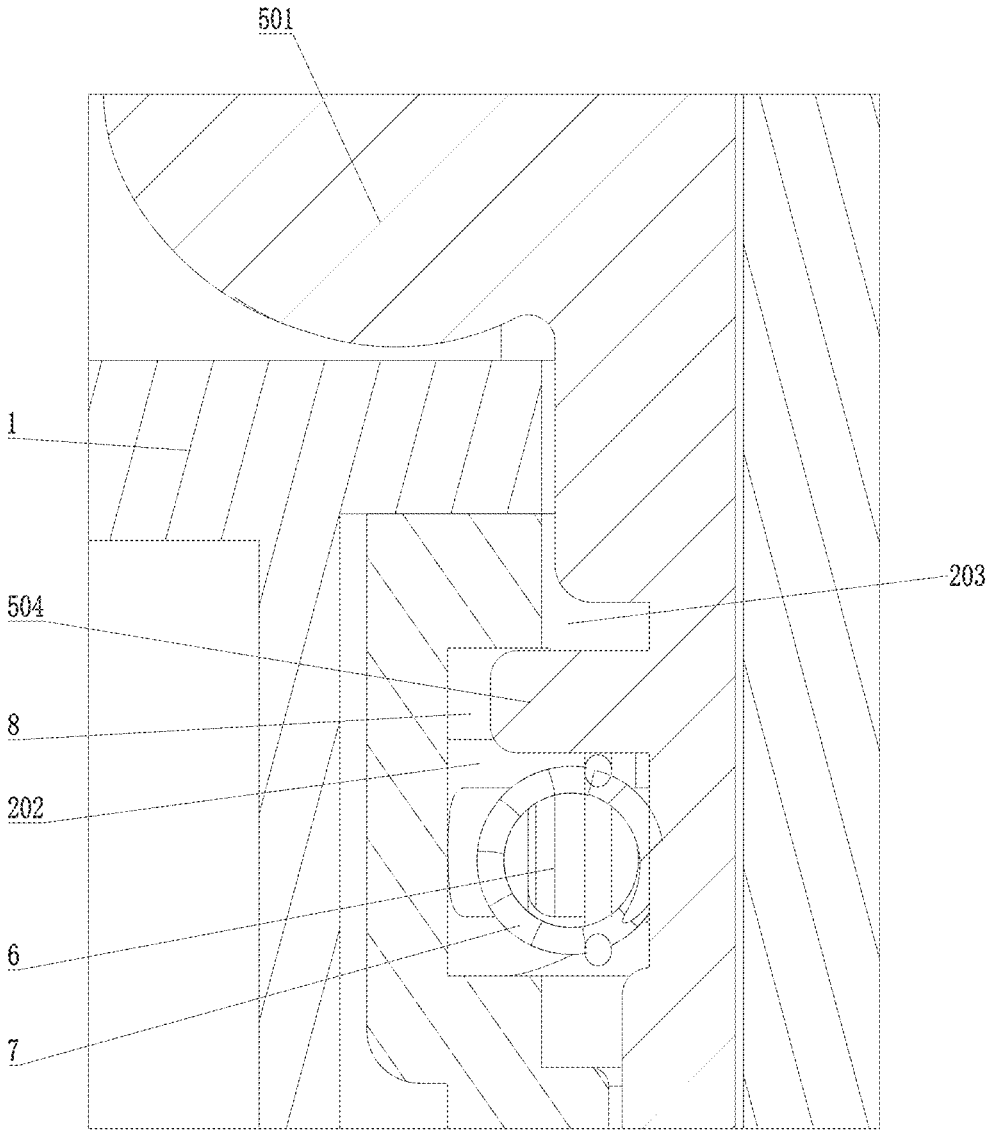
FIG. 3 is a partial enlarged view of A in FIG. 2.
Figure 4:
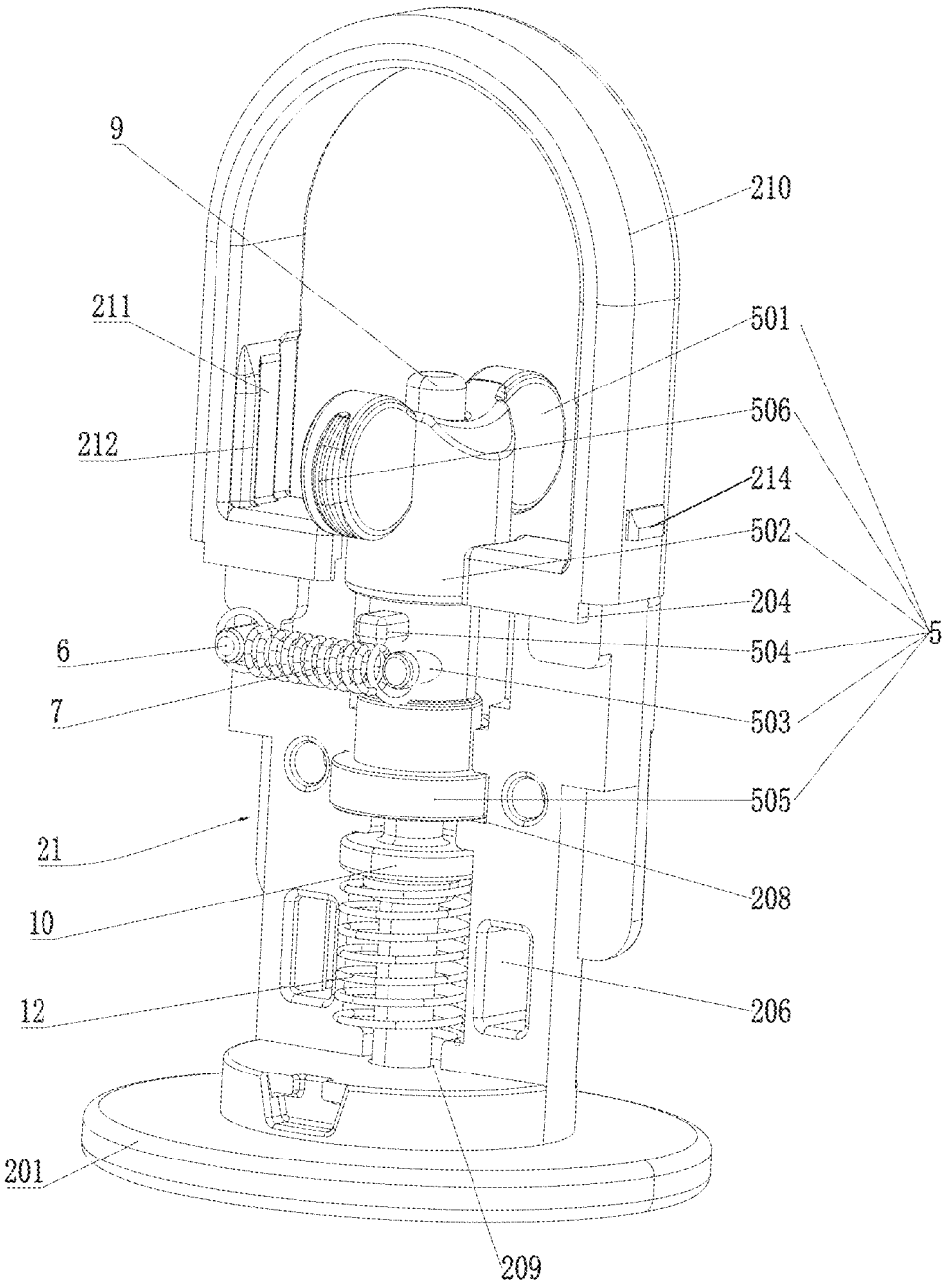
FIG. 4 is a schematic partial structural view of the present disclosure in a locked state.
Figure 5:
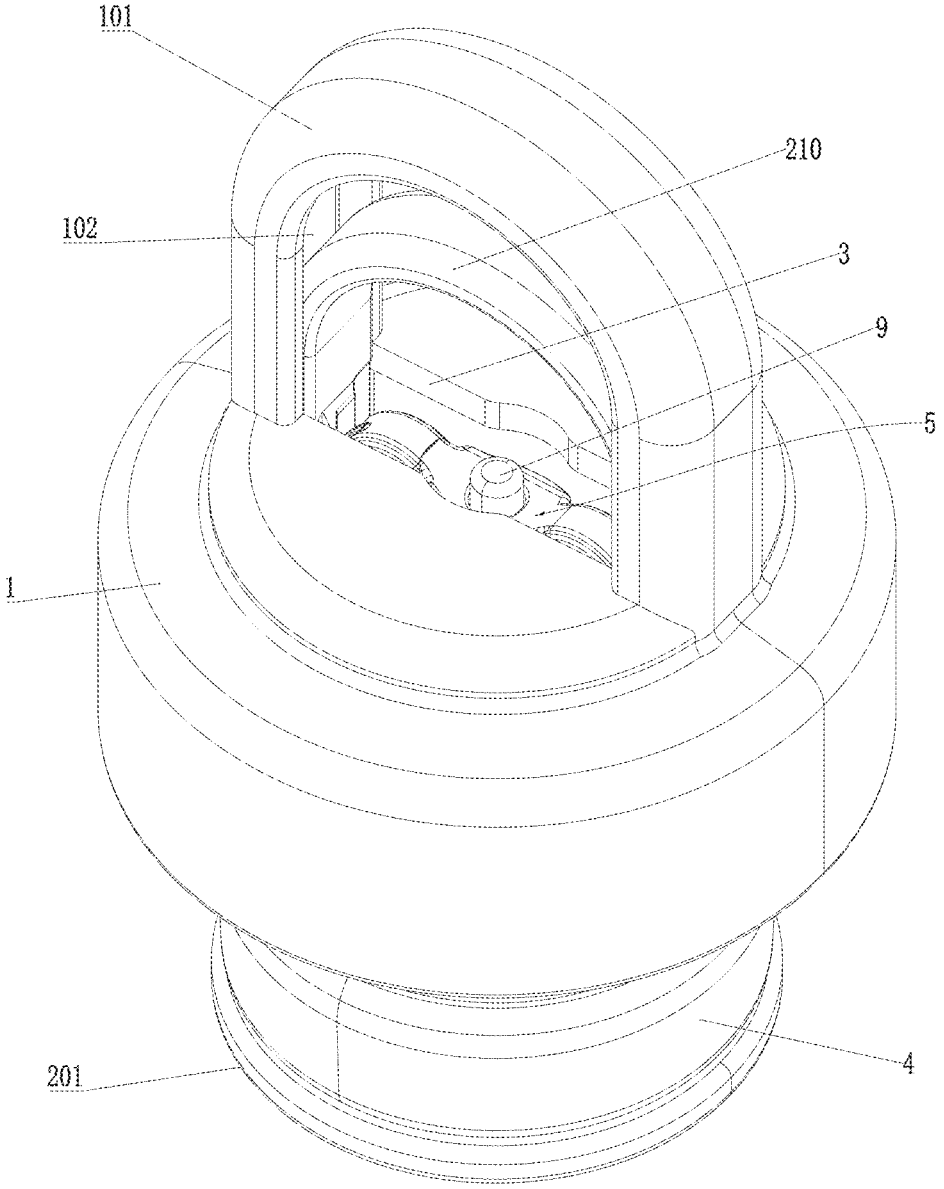
FIG. 5 is a schematic overall structural view of the present disclosure in an unlocked state.
Figure 6:
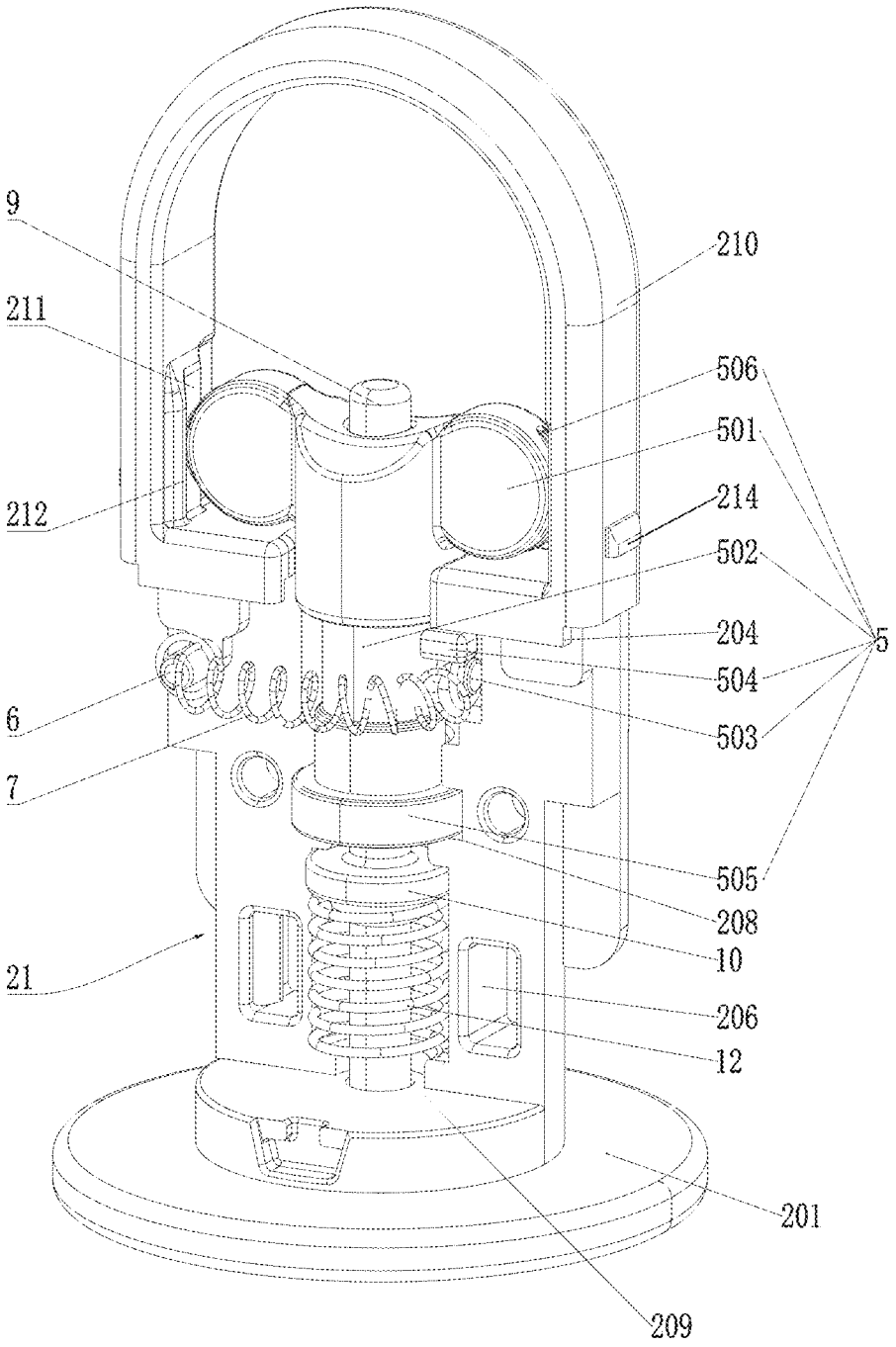
FIG. 6 is a schematic partial structural view of the present disclosure in an unlocked state.
Figure 7:
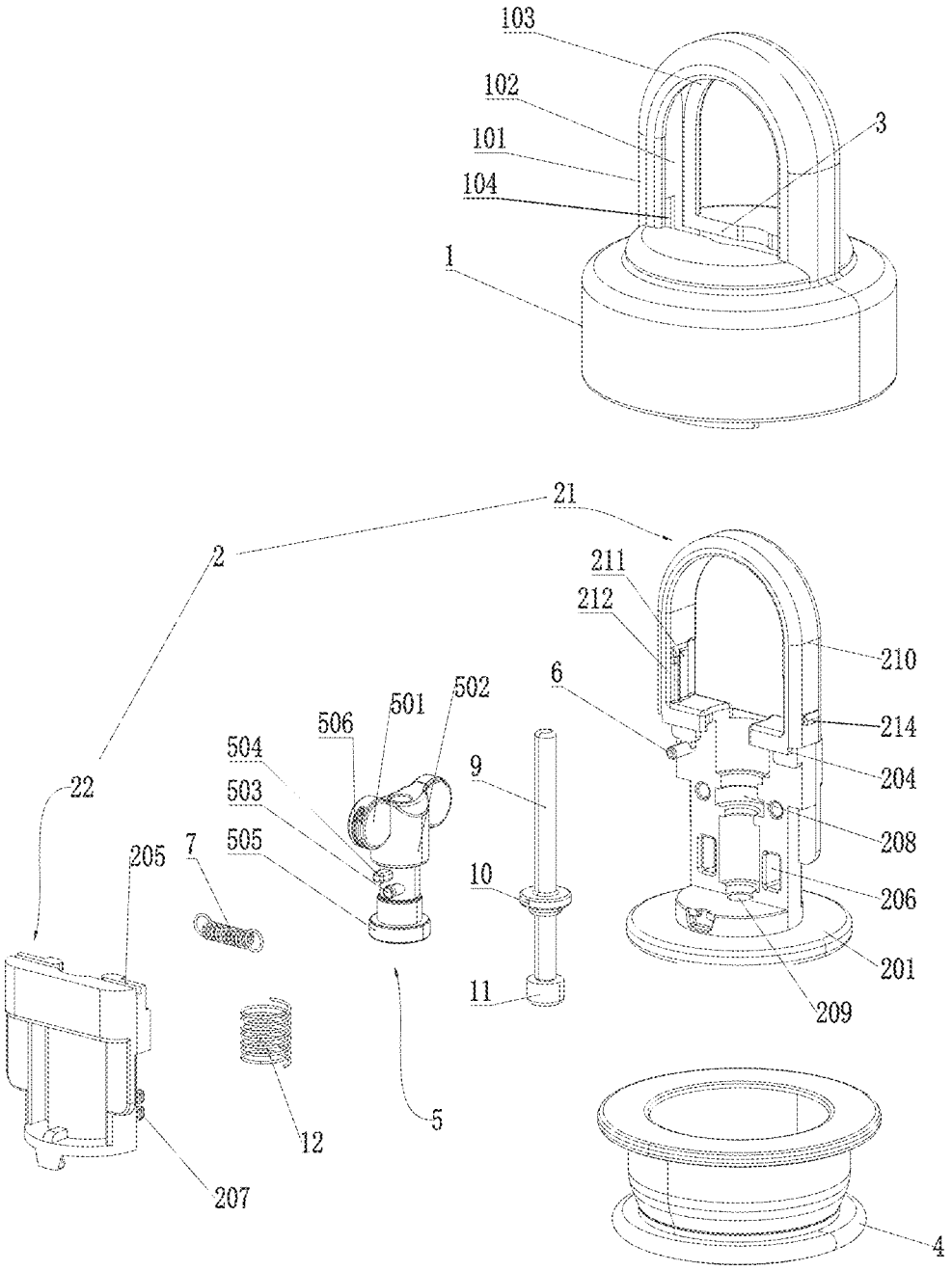
FIG. 7 is an exploded view of the present disclosure.
Figure 8:
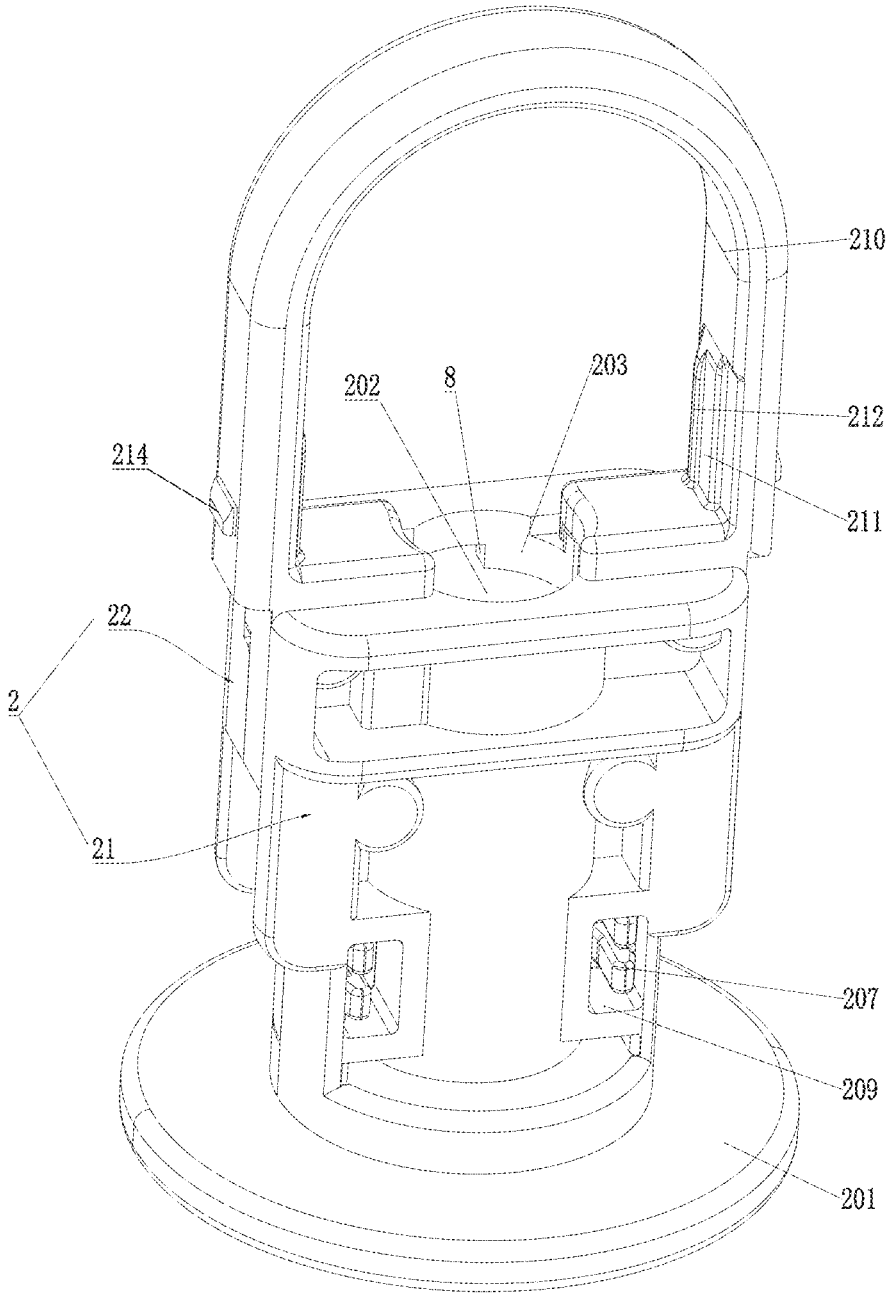
FIG. 8 is a schematic view of a movable stopper body of the present disclosure.
Figure 9:
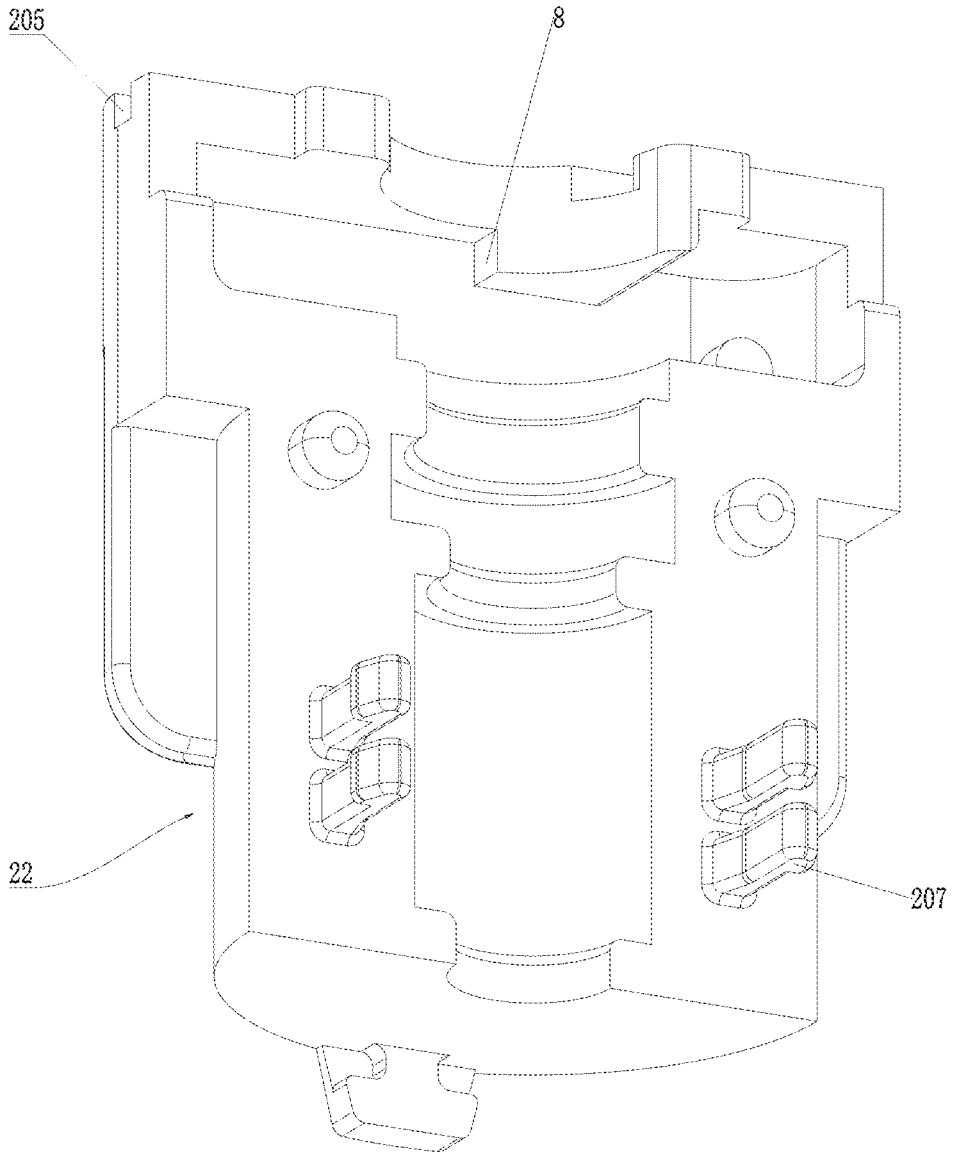
FIG. 9 is a schematic view of a cover plate of the present disclosure.
Figure 10:
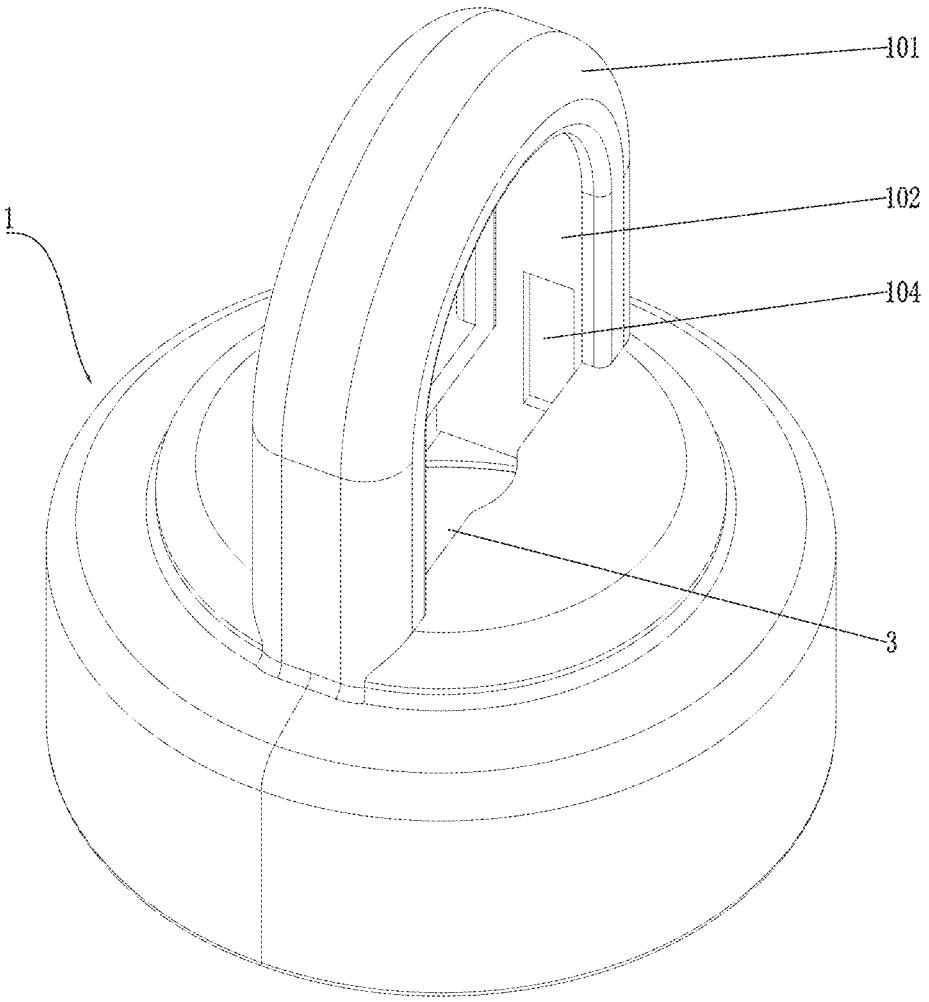
FIG. 10 is a schematic view of a fixed shell of the present disclosure.

Referring to FIGS. 2, 3 and 8, the movable stopper body 2 includes an accommodating cavity 202 and a mounting hole 203 communicated with each other. The mounting hole 203 is configured for the central post 502 to pass through. The first connector 503 and the first elastic member 7 are both located in the accommodating cavity 202, and the second connector 6 is arranged on an inner wall of the accommodating cavity 202. Corrosion of water vapor on the first connector 503, the second connector 6 and the first elastic member 7 is avoided, so that the service life is prolonged. Moreover, breeding of bacteria is reduced, which makes the container stopper more sanitary to use.

The movable stopper body 2 includes a stopper body main body 21 and a cover plate 22 that are detachably connected, and the accommodating cavity 202 and the mounting hole 203 are both formed by splicing the stopper body main body 21 and the cover plate 22. The movable stopper body 2 is simple in structure, so that the movable stopper body 2 is convenient to assemble.

Preferably, the limiting edge 8 is arranged on the cover plate 22 and disposed in the 202, and the limiting block 504 is also disposed in the accommodating cavity 202, thereby avoiding corrosion of water drops on the limiting edge 8 and the limiting block 504, and thus prolonging the service life.

Referring to FIGS. 4, 6, 7 and 9, the stopper body main body 21 and the cover plate 22 are respectively provided with a convex portion 204 and a concave portion 205, or the stopper body main body 21 and the cover plate 22 are respectively provided with the concave portion 205 and the convex portion 204. The convex portion 204 and the concave portion 205 are matched with each other. The stopper body main body 21 and the cover plate 22 are respectively provided with a through hole 206 and a hook 207, or the stopper body main body 21 and the cover plate 22 are respectively provided with the hook 207 and the through hole 206. The through hole 206 is arranged in a strip shape in the vertical direction, and the hook 207 and the through hole 206 are detachably connected. After the concave portion 205 and the convex portion 204 are butted with each other, the hook 207 and the through hole 206 can be clamped with each other so as to complete the connection and mounting of the stopper body main body 21 and the cover plate 22, which makes the mounting very convenient.

Preferably, the convex portion 204 and the concave portion 205 are respectively arranged on the stopper body main body 21 and the cover plate 22. Preferably, the hook 207 and the through hole 206 are respectively arranged on the cover plate 22 and the stopper body main body 21.

A bottom of the central post 502 is provided with a positioning disk 505 extending outward, an annular groove 208 matched with the positioning disk 505 is arranged inside the movable stopper body 2, and the positioning disk 505 and the annular groove 208 are rotatably connected. The axial position of the central post 502 relative to the movable stopper body 2 can be determined by positioning the positioning disk 505 and the annular groove 208, which is simple in structure and convenient to mount.

Referring to FIGS. 2, 3, 4, 6 and 7, the present disclosure further includes a movable rod 9. A side edge of the movable rod 9 is provided with a limiting disk 10. A bottom of the movable rod 9 is provided with a sealing block 11. A movable cavity 213 for accommodating the limiting disk 10 is arranged in the movable stopper body 2. A second elastic member 12 abuts against and between the limiting disk 10 and a bottom of the movable cavity 213. A middle part of the limiting plate 201 is provided with a venthole 209 communicated with the movable cavity 213. An upper part of the movable rod 9 runs through the knob 5. Under normal conditions, when the second elastic member 12 extends to its limit, the sealing block 11 blocks the venthole 209 to ensure the air tightness of the present disclosure. Thus, when opening the container stopper, the user may press an upper end of the movable rod 9 to push the sealing block 11 to move downward and open the venthole 209, so that an air pressure balance between the inside and the outside can be achieved, thereby preventing the air pressure from inhibiting the opening of the container stopper.

Preferably, the second elastic member 12 is also a spring.

Referring to FIGS. 1, 2, 5, 6, 7, 8 and 10, the fixed shell 1 includes a hollow grip 101, and the movable stopper body 2 includes a handle 210. A sliding slot 102 slidably connected with an edge of the movable stopper body 2 is provided in the fixed shell 1. The hollow grip 101 is provided with an arc groove 103 for accommodating the handle 210. The sliding slot 102 and the arc groove 103 are communicated with each other. The user can drive the movable stopper body 2 to move upward simply by pulling the handle 210, which makes the container stopper more convenient to use.

Referring to FIGS. 1, 4, 6 and 7, an outer side of the side lug 501 is provided with a squeezing protrusion 506, an inner side of the handle 210 is provided with a squeezing surface 211 for abutting against and locking the squeezing protrusion 506, and a side edge of the squeezing surface 211 is provided with a stop block 212. When the knob 5 is rotated until the squeezing protrusion 506 abuts against the stop block 212, the squeezing protrusion 506 abuts against and locks the squeezing surface 211, so that the movable stopper body 2 together with the knob 5 can smoothly pass through the dodging opening 3 during the assembly process of the present disclosure, which makes the container stopper convenient to assemble.

Referring to FIGS. 4, 6, 7, 8 and 10, a side edge of the movable stopper body 2 is provided with a limiting protrusion 214, and the inside of the fixed shell 1 is provided with a strip-shaped limiting slot 104 in the vertical direction. The limiting protrusion 214 is slidably connected in the strip-shaped limiting slot 104. In the unlocked state, the limiting protrusion 214 abuts against a bottom end of the strip-shaped limiting slot 104. The distance between the movable stopper body 2 and the fixed shell 1 can be effectively limited, which avoids useless work and improves use efficiency.

Preferably, two limiting protrusions 214 are provided and arranged symmetrically, and two strip-shaped limiting slots 104 are provided and arranged symmetrically.

Referring to FIG. 1 to FIG. 10, when the present disclosure switches from the unlocked state to the locked state, the user only needs to pull up the handle 210. During this process, the whole elastic sealing sleeve 4 is squeezed by the limiting plate 201 and the fixed shell 1, so that the elastic sealing sleeve 4 bulges outward to seal the container. After the side lug 501 leaves the dodging opening 3, the knob 5 is rotated under the pulling force of the first elastic member 7, so that the side lug 501 automatically rotates to extend beyond the contour range of the dodging opening 3 and the limiting block 504 rotates to abut against the limiting edge 8. At this time, the present disclosure is in the locked state.

When the present disclosure switches from the locked state to the unlocked state, the user needs to rotate the knob 5 such that the whole knob 5 is within the contour range of the dodging opening 3. The knob 5 and the movable stopper body 2 are moved downward relative to the fixed shell 1 under the elastic force of the elastic sealing sleeve 4, and the elastic sealing sleeve 4 stretches and returns to its original shape to unlock the container opening. At the same time, the user may press down the upper end of the movable rod 9 exposed from the knob 5, so that the sealing block 11 at a lower end of the movable rod 9 opens the venthole 209, thereby achieving the air pressure balance between the inside and the outside.

The foregoing descriptions are merely exemplary examples of the present disclosure, and are not intended to limit the patent scope of the present disclosure. Under the inventive concept of the present disclosure, any equivalent structural changes made by using the contents of the Description and Drawings of the present disclosure, or direct/indirect applications in other related technical fields are included in the patent protection scope of the present disclosure.

What is claimed is:

1. A quick opening and closing container stopper, comprising: a fixed shell with a hollow inside, a movable stopper body being slidably connected in the fixed shell in a vertical direction, and the fixed shell being provided with a dodging opening, a bottom of the movable stopper body being provided with a limiting plate, an elastic sealing sleeve abutting against and between the limiting plate and the fixed shell, a knob being rotatably connected to the movable stopper body, the knob comprises a side lug, and the container stopper being switchable between a locked state and an unlocked state;

in the locked state, the side lug extending beyond a contour range of the dodging opening, and the fixed shell and the limiting plate being close to each other and driving the elastic sealing sleeve to bulge outward; and in the unlocked state, the side lug being accommodated in the dodging opening, and the elastic sealing sleeve stretching while the fixed shell and the limiting plate are away from each other.

2. The quick opening and closing container stopper according to claim 1, wherein the knob comprises a central post, a side surface of the central post being provided with a first connector, the movable stopper body being provided with a second connector, a first elastic member being connected between the first connector and the second connector, and wherein when the knob switches from the locked state to the unlocked state, the first elastic member is extended and tightened.

3. The quick opening and closing container stopper according to claim 2, wherein the movable stopper body being provided with a limiting edge, and a side edge of the central post being provided with a limiting block; and in the locked state, the limiting block abutting against the limiting edge.

4. The quick opening and closing container stopper according to claim 3, wherein the movable stopper body comprises an accommodating cavity and a mounting hole in communication with each other, the mounting hole being configured for the central post to pass through, the first connector and the first elastic member being both located in the accommodating cavity, and the second connector being arranged on an inner wall of the accommodating cavity.

5. The quick opening and closing container stopper according to claim 4, wherein the movable stopper body comprises a stopper body main body and a cover plate that are detachably connected, and the accommodating cavity and the mounting hole being both formed by the stopper body main body and the cover plate.

6. The quick opening and closing container stopper according to claim 5, wherein the stopper body main body and the cover plate being respectively provided with a convex portion and a concave portion, or the stopper body main body and the cover plate being respectively provided with the concave portion and the convex portion, and the convex portion and the concave portion being matched with each other; the stopper body main body and the cover plate being respectively provided with a through hole and a hook, or the stopper body main body and the cover plate being respectively provided with the hook and the through hole, and the hook and the through hole being detachably connected.

7. The quick opening and closing container stopper according to claim 6, wherein a bottom of the central post being provided with a positioning disk extending outward, an annular groove matched with the positioning disk being arranged inside the movable stopper body, and the positioning disk and the annular groove being rotatably connected.

8. The quick opening and closing container stopper according to claim 7, further comprising a movable rod, wherein a side edge of the movable rod being provided with a limiting disk, a bottom of the movable rod being provided with a sealing block, a movable cavity for accommodating the limiting disk being arranged in the movable stopper body, a second elastic member abutting against and between the limiting disk and a bottom of the movable cavity, a middle part of the limiting plate being provided with a venthole communicated with the movable cavity, and an upper part of the movable rod running through the knob.

9. The quick opening and closing container stopper according to claim 8, wherein the fixed shell comprises a hollow grip, the movable stopper body comprises a handle, a sliding slot slidably connected with an edge of the movable stopper body being provided in the fixed shell, the hollow grip being provided with an arc groove for accommodating the handle, and the sliding slot and the arc groove being in communication with each other.

10. The quick opening and closing container stopper according to claim 9, wherein an outer side of the side lug being provided with a squeezing protrusion, an inner side of the handle being provided with a squeezing surface for abutting against and locking the squeezing protrusion, and a side edge of the squeezing surface being provided with a stop block.

11. The quick opening and closing container stopper according to claim 10, wherein a side edge of the movable stopper body being provided with a limiting protrusion, and an inside of the fixed shell being provided with a limiting slot in the vertical direction, the limiting protrusion being slidably connected in the limiting slot; and in the unlocked state, the limiting protrusion abutting against a bottom end of the limiting slot.

* * * * *